US008395561B2

(12) United States Patent
Park et al.

(10) Patent No.: US 8,395,561 B2
(45) Date of Patent: Mar. 12, 2013

(54) DUAL POLARIZATION BROADBAND ANTENNA HAVING WITH SINGLE PATTERN

(75) Inventors: Joo Sung Park, Incheon-shi (KR); Jae Sun Jin, Incheon-shi (KR)

(73) Assignee: Ace Antenna Corp., Incheon-si (KR)

( * ) Notice: Subject to any disclaimer, the term of this patent is extended or adjusted under 35 U.S.C. 154(b) by 435 days.

(21) Appl. No.: 12/296,105

(22) PCT Filed: Apr. 2, 2007

(86) PCT No.: PCT/KR2007/001597

§ 371 (c)(1),
(2), (4) Date: Oct. 3, 2008

(87) PCT Pub. No.: WO2007/114620

PCT Pub. Date: Oct. 11, 2007

(65) Prior Publication Data

US 2009/0179814 A1 Jul. 16, 2009

(30) Foreign Application Priority Data

Apr. 3, 2006 (KR) ..... 10-2006-0030232
Mar. 14, 2007 (KR) ..... 10-2007-0025085

(51) Int. Cl.

| | |
|---|---|
| ***H01Q 9/26*** | (2006.01) |
| ***H01Q 21/26*** | (2006.01) |
| ***H01Q 9/28*** | (2006.01) |
| ***H01Q 21/20*** | (2006.01) |
| ***H01Q 1/38*** | (2006.01) |

(52) U.S. Cl. ..... 343/803; 343/797; 343/795; 343/798; 343/799; 343/804; 343/700 MS

(58) Field of Classification Search ..... 343/797, 343/795, 798, 799, 803, 804, 700 MS
See application file for complete search history.

(56) References Cited

U.S. PATENT DOCUMENTS 2,761,140 A * 8/1956 Ashton ..... 343/803
3,740,754 A * 6/1973 Epis ..... 343/797
(Continued)

FOREIGN PATENT DOCUMENTS

CN 1591976 A 3/2005
EP 1434300 A2 6/2004
(Continued)

OTHER PUBLICATIONS

International Search Report (ISR) and Written Opinion for International Application PCT/KR2007/001597 dated Jul. 23, 2007.

(Continued)

*Primary Examiner* — Jacob Y Choi
*Assistant Examiner* — Graham Smith
(74) *Attorney, Agent, or Firm* — LRK Patent Law Firm

(57) ABSTRACT

The present invention relates to a dual polarization broadband antenna having a single pattern, which is provide with a radiation device having a square structure, in which a plurality of folded dipole elements are formed in a single continuously-connected pattern, and a feeding portion for feeding signals to the plurality of folded dipole elements is formed on the radiation device. Accordingly, the plurality of folded dipole elements formed on the radiation device are connected in a single square and rectangular pattern, so that the structure thereof is simplified, with the result that the cost can be reduced. Furthermore, the feeding portion, that dually feeds signals, and the plurality of folded dipole elements, connected in a single pattern, are coupled, so that the dual polarization characteristic can be easily acquired. Furthermore, currents input to the feeding points of the feeding portion are induced only to the folded dipole elements without having to flow into other feeding points, so that excellent isolation can be achieved.

6 Claims, 11 Drawing Sheets

U.S. PATENT DOCUMENTS

| | | | | |
|---|---|---|---|---|
| 5,061,944 | A * | 10/1991 | Powers et al. | 343/795 |
| 6,400,332 | B1 * | 6/2002 | Tsai et al. | 343/795 |
| 6,650,301 | B1 * | 11/2003 | Zimmerman | 343/803 |
| 2004/0155831 | A1 | 8/2004 | Goebel et al. | |

FOREIGN PATENT DOCUMENTS

| | | | |
|---|---|---|---|
| JP | 06-177635 | A | 6/1994 |
| JP | P2003-535541 | A | 11/2003 |
| KR | 2001-0040623 | A | 5/2001 |
| KR | 10-2004-0005255 | A | 1/2004 |
| KR | 10-0853670 | B1 | 8/2008 |
| WO | 01/93372 | A1 | 12/2001 |

OTHER PUBLICATIONS

European Search Report for European Application No. 07745760.4 which corresponds to U.S. Appl. No. 12/296,105.

SIPO Office Action for Chinese Patent Application No. 03155951 which corresponds to the above-identified application.

* cited by examiner

DUAL POLARIZATION BROADBAND ANTENNA HAVING WITH SINGLE PATTERN

TECHNICAL FIELD

The present invention relates to a dual polarization broadband antenna having a single pattern and, more particularly, to a dual polarization broadband antenna, which has both a dual polarization characteristic and a broadband characteristic because it uses a structure in which a plurality of folded dipole elements are formed in a single continuous pattern on a radiation device, which is coupled to a dual feeding portion.

BACKGROUND ART

As an example of a conventional dual polarization dipole antenna, the dual polarization dipole antenna disclosed in Korean Unexamined Patent Publication No. 2001-0040623 transmits polarized electrical radiation at an angle of +45° or −45° in relation to a predetermined arrangement of dipoles. The ends of the symmetrical or approximately symmetrical lines, which lead to respective dipole halves, are interconnected in such a way that the corresponding line halves of adjacent dipole halves, which are perpendicular to each other, are electrically connected, and the supply of electrical power to the diametrically opposite dipole halves results in a first polarization, and decouples a second polarization which is orthogonal thereto.

However, the conventional technology has a structure in which four dipoles are uniformly separated from each other, so that there is a problem in that the structure of the antenna is complicated.

Furthermore, the four uniformly-separated dipoles and two pairs of symmetrical feeding portions are made of a metal material and are coupled to each other on a radiation substrate, so there are problems, not only in that impedance matching is difficult to achieve, but also in that the broadband characteristic and the antenna gain are lowered.

DISCLOSURE

Technical Problem

Accordingly, the present invention has been made keeping in mind the above problems occurring in the prior art, and an object of the present invention is to provide an antenna having a simple structure, in which a plurality of folded dipole elements formed on a radiation device are connected in a single square and rectangular pattern.

Another object of the present invention is to form the plurality of folded dipole elements on the radiation device in a single pattern, thus not only facilitating impedance matching but also further improving the broadband characteristic and the antenna gain.

A further object of the present invention is to decrease squint error by forming the plurality of folded dipole elements at different lengths, thus decreasing signal noise occurring at the time of transmission and reception.

Technical Solution

In order to accomplish the above objects, the present invention provides a dual polarization broadband antenna having a single pattern, including a radiation device having a square structure, in which a plurality of folded dipole elements are formed in a single continuous pattern; and a feeding portion for feeding signals to the plurality of folded dipole elements formed on the radiation device.

In accordance with an embodiment of the present invention, each of the plurality of folded dipole elements comprises a feeding line portion and a radiation portion.

In accordance with an embodiment of the present invention, the feeding portion includes four feeding points, the four feeding points being formed to cross each other and configured to feed the signals.

In accordance with an embodiment of the present invention, the plurality of folded dipole elements causes polarization through the vector addition of electrical fields formed by the flow of a current fed to the feeding portion.

In accordance with an embodiment of the present invention, the plurality of folded dipole elements forms dual polarizations using a single pattern in response to the signals that are dually fed to the feeding portion single pattern.

In accordance with an embodiment of the present invention, the plurality of folded dipole elements causes a polarization direction to be formed at an angle of +45° or −45° in response to the signals that are dually fed to the feeding portion.

In addition, the present invention provides a dual polarization broadband antenna having a single pattern, including a radiation device having a rectangular structure, in which a plurality of folded dipole elements are formed in a single continuous pattern, and a feeding portion for feeding signals to the plurality of folded dipole elements formed on the radiation device.

In accordance with another embodiment of the present invention, each of the plurality of folded dipole elements comprises a feeding line portion and a radiation portion.

In accordance with another embodiment of the present invention, the feeding portion comprises four feeding points, the four feeding points being formed to cross each other and configured to feed the signals.

In accordance with another embodiment of the present invention, the plurality of folded dipole elements are formed at different lengths.

In accordance with another embodiment of the present invention, the plurality of folded dipole elements decreases squint error.

In accordance with another embodiment of the present invention, the plurality of folded dipole elements causes polarization through the vector addition of electrical fields formed by the flow of a current fed to the feeding portion.

In accordance with another embodiment of the present invention, the plurality of folded dipole elements forms dual polarizations using a single pattern in response to the signals that are dually fed to the feeding portion single pattern.

In accordance with another embodiment of the present invention, the plurality of folded dipole elements causes a polarization direction to be formed at an angle of +45° or −45° in response to the signals that are dually fed to the feeding portion.

Advantageous Effects

According to the present invention, the plurality of folded dipole elements formed on the radiation device are connected in a single square and rectangular pattern, so that the structure thereof is simplified and the manufacturing thereof is convenient, with the result that the cost can be reduced. Furthermore, the feeding portion dually feeds signals to the plurality of folded dipole elements, so that the dual polarization characteristic can be acquired using the single pattern. Furthermore, the plurality of folded dipole elements formed on the radiation device is elaborately and conveniently formed using the single pattern, so that the impedance matching can be easily achieved and the broadband characteristic and the antenna gain can be improved. Furthermore, currents input to the feeding points of the feeding portion are induced to the folded dipole elements without having to flow into other feeding points, so that excellent isolation characteristics can be achieved. Furthermore, the plurality of folded dipole elements are formed at different lengths, so that the squint error can be decreased. Accordingly, the signal noise occurring at the time of transmission and reception can be decreased.

DESCRIPTION OF REFERENCE NUMERALS OF PRINCIPLE ELEMENTS

Figure 1:
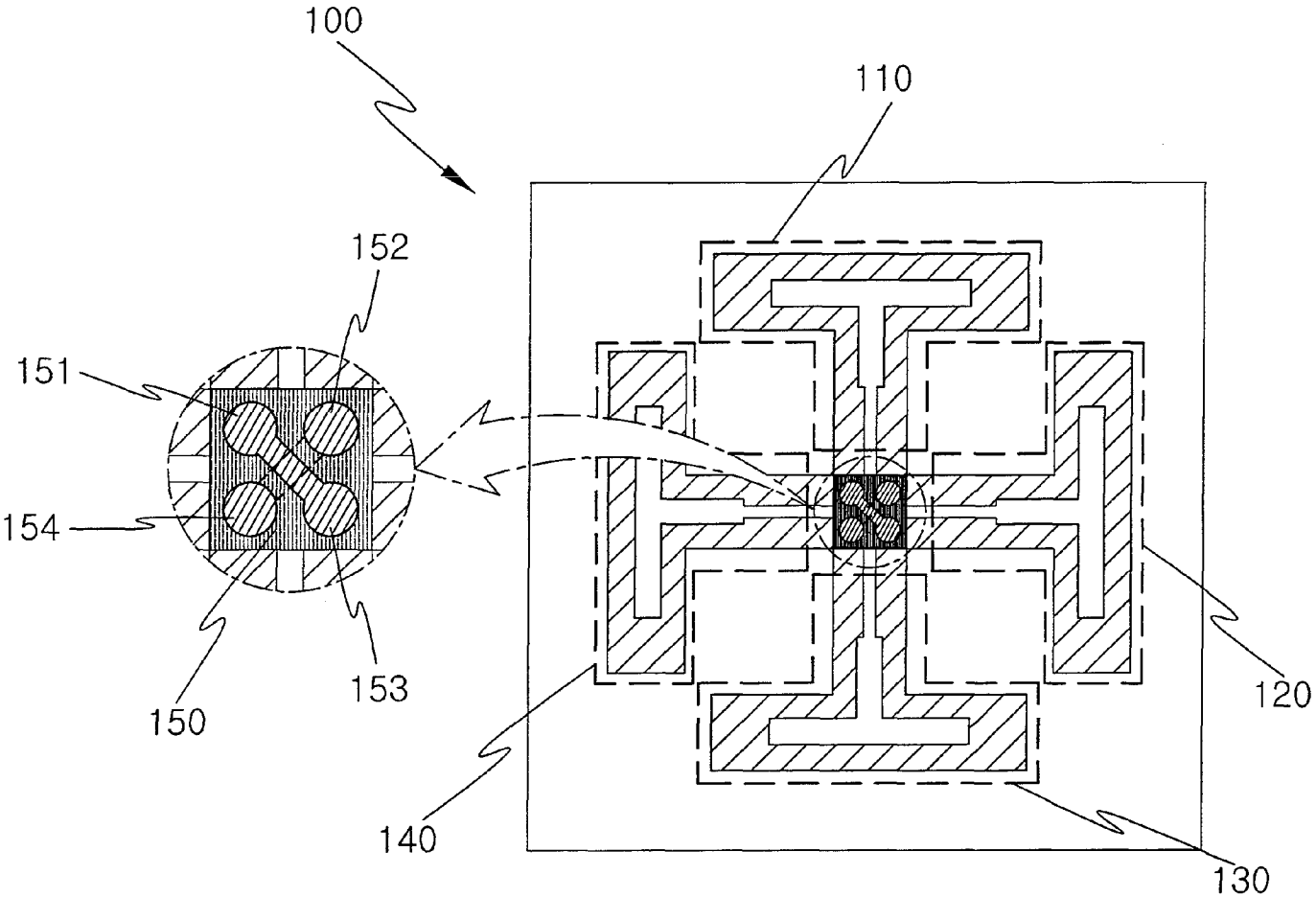
FIG. 1 is a front view of a dual polarization broadband antenna having a single pattern according to an embodiment of the present invention.

100, 500: radiation devices
110, 510: first folded dipole elements
111, 511: first feeding line portions
112, 512: first radiation portions
120, 520: second folded dipole elements
121, 521: second feeding line portions
122, 522: second radiation portions
130, 530: third folded dipole elements
131, 531: third feeding line portions
132, 532: third radiation portions
140, 540: fourth folded dipole elements
141, 541: fourth feeding line portions
142, 542: fourth radiation portions
150, 550: feeding portions
151, 551: first feeding points
152, 552: second feeding points
153, 553: third feeding points
154, 554: fourth feeding points
200, 600: direction of current
300, 700: direction of electric field
400, 800: direction of polarization

MODE FOR INVENTION

FIG. 1 is a front view of a dual polarization broadband antenna having a single pattern according to an embodiment of the present invention. The dual polarization broadband antenna includes a radiation device 100 having a square structure, in which a plurality of folded dipole elements 110, 120, 130 and 140 are formed in a single continuously-connected pattern and a feeding portion 150 for feeding signals to the plurality of folded dipole elements 110, 120, 130 and 140 formed on the radiation device 100.

In greater detail, the radiation device 100 is configured such that the first to fourth folded dipole elements 110, 120, 130 and 140 are formed thereon and are coupled to the feeding portion 150 in order to feed signals, thus radiating a signal formed using vector addition for the first to fourth folded dipole elements 110, 120, 130 and 140.

The feeding portion 150 is configured such that first to fourth feeding points 151, 152, 153 and 154 are formed in respective locations, in which the first to fourth feeding line portions 111, 121, 131 and 141 of the first to fourth folded dipole elements 110, 120, 130 and 140 are interconnected, the first feeding point 151 and the third feeding point 153 are connected to each other, the second feeding point 152 and the fourth feeding point 154 are connected to each other, and the connected first and third feeding points 151 and 153 and the connected second and fourth feeding points 152 and 154 are formed to cross each other, thus causing dual polarization by enabling signals, which are supplied from the outside, to be dually fed to the first to fourth folded dipole elements 110, 120, 130 and 140.

Furthermore, the current flowing into the feeding portion 150 is induced only by the first to fourth folded dipole elements 110, 120, 130 and 140, so that excellent isolation characteristics can be achieved.

Figure 2:
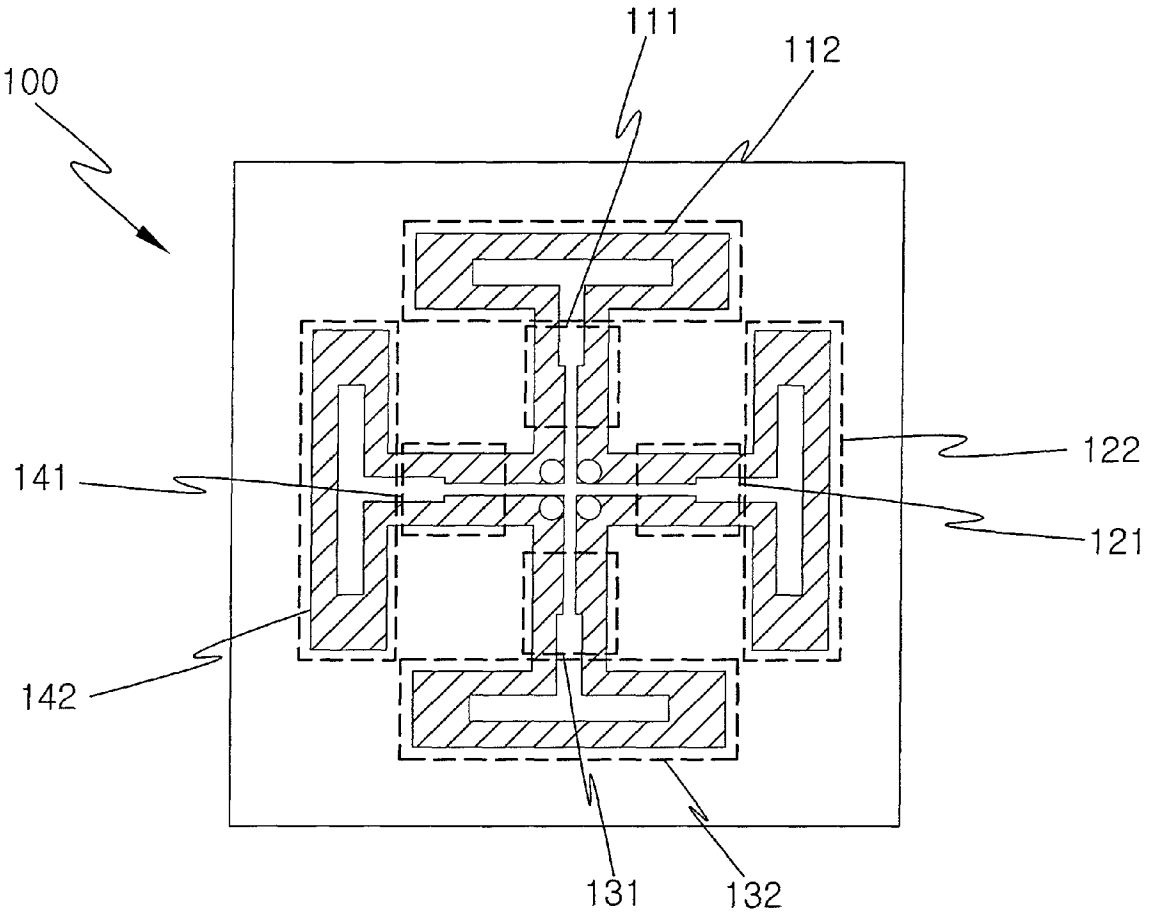
FIG. 2 is a diagram showing the construction of a folded dipole antenna having a single pattern according to FIG. 1 of the present invention.

The first folded dipole element 110, as shown in FIG. 2, is provided with the first radiation portion 112 and the first feeding line portion 111. In this case, current supplied from the outside to the feeding portion 150 flows into the first feeding line portion 111, and the current flowing into the first feeding line portion 111 is induced to the first radiation portion 112.

Furthermore, the second, third and fourth folded dipole elements 120, 130 and 140 are respectively provided with the second feeding line portion 121 and a second radiation portion 122, the third feeding line portion 131 and a third radiation portion 132, and the fourth feeding line portion 141 and a fourth radiation portion 142. In this case, current is induced to each of the second, third and fourth radiation portions 122, 132 and 142 in response to the signals that flow into the feeding portion 150.

Figure 3:
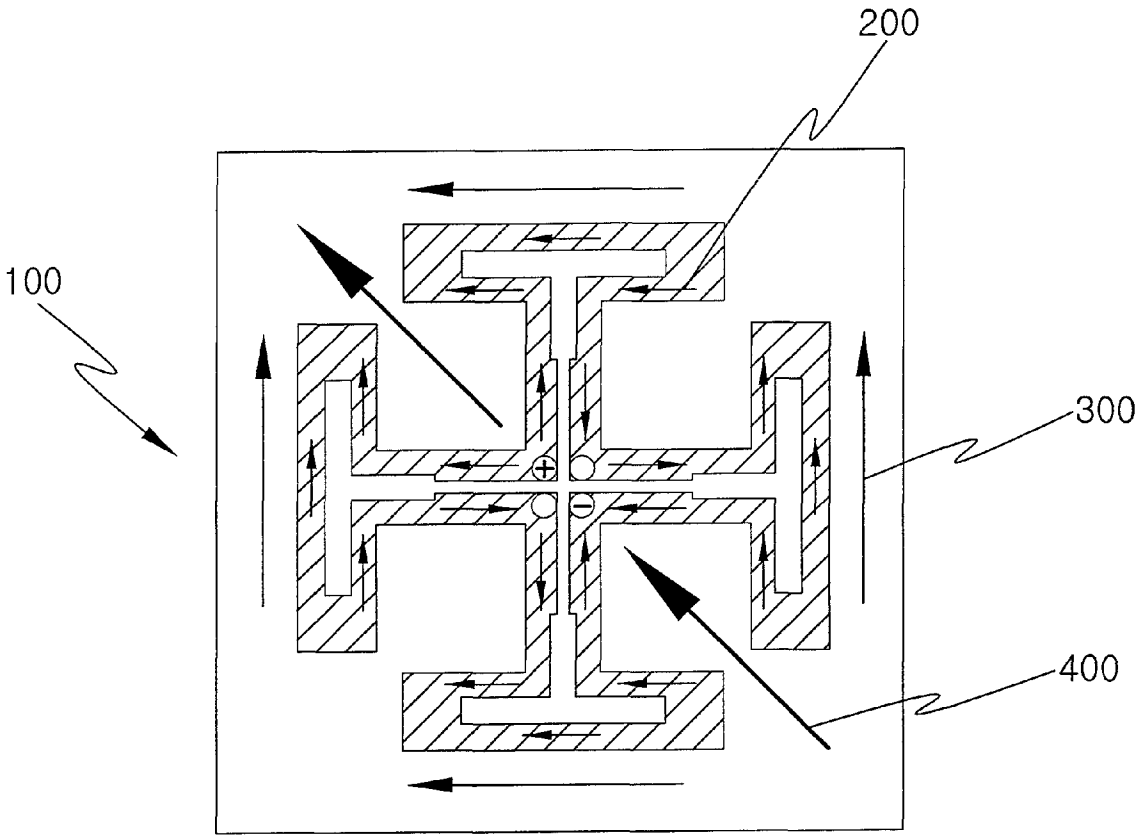
FIG. 3 is a diagram showing polarization caused by a first current flow according to FIG. 1 of the present invention.
Figure 4:
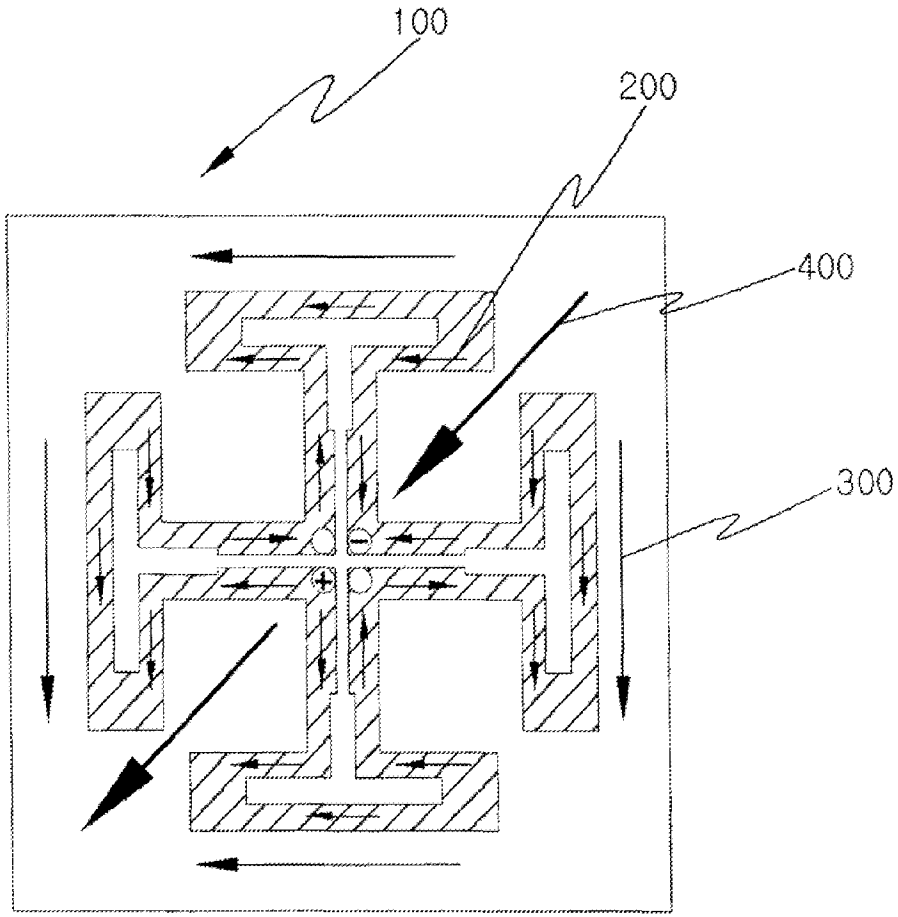
FIG. 4 is a diagram showing polarization caused by a second current flow according to FIG. 1 of the present invention.

FIG. 3 is a diagram showing polarization caused by a first current flow according to FIG. 1 of the present invention, in which one of the dual polarizations, obtained through the vector addition of an electric field generated by the first current flow, is shown. FIG. 4 is a diagram showing polarization caused by a second current flow according to FIG. 1 of the present invention, in which the other polarization, which is obtained through the vector addition of an electrical field generated by the second current flow, is shown.

In greater detail, as shown in FIG. 3, a positive (+) current is applied to the first feeding point 151 and a negative (−) current is applied to the third feeding point 153, so that current directions 200 are respectively formed along the first to fourth folded dipole elements 110, 120, 130 and 140 by the applied currents, the directions 300 of respective electric fields are formed to correspond to the first to fourth folded dipole elements 110, 120, 130 and 140 by the flow of the currents, and a polarization direction 400 is formed at an angle of +45° by the vector addition of the formed electric fields.

In FIG. 4, a positive (+) current is applied to the fourth feeding point 154 and a negative (−) current is applied to the second feeding point 152, so that the directions 300 of electric fields are determined by the current directions 200 of the first to fourth folded dipole elements 110, 120, 130 and 140, and a polarization direction 400 is formed at an angle of −45° by the vector addition of the formed electric fields.

Accordingly, as shown in FIGS. 3 and 4, the directions 300 of electric fields are determined by the current directions 200, and the polarization direction 400 is formed at an angle of +45° or −45° by the vector addition of the formed electric fields, and thus the dual polarization characteristic for the polarization direction 400 can be achieved.

Figure 5:
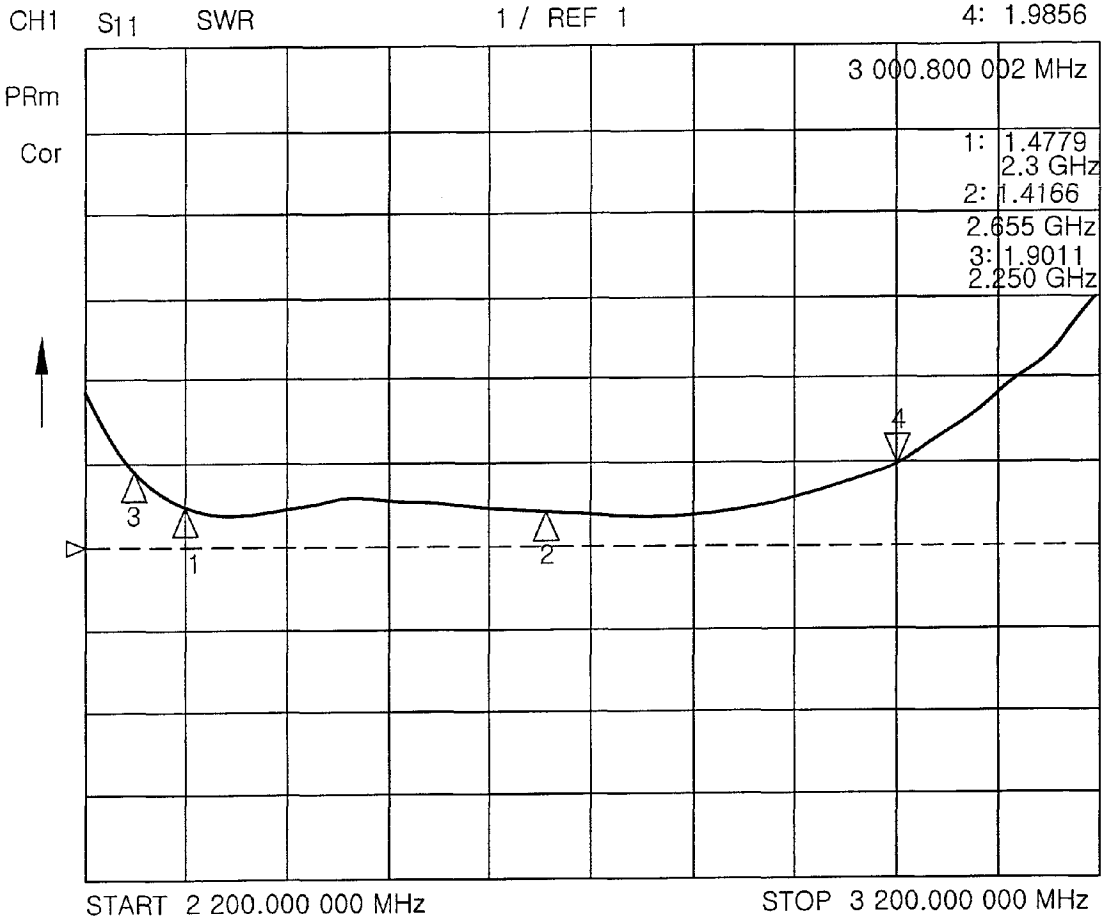
FIG. 5 is a characteristic diagram showing a standing-wave ratio according to FIG. 1 of the present invention.

FIG. 5 is a characteristic diagram showing a standing-wave ratio according to FIG. 1 of the present invention. When a standing wave ratio is 2:1, an efficiency of about 90% is exhibited. In the proposed antenna, the range of a frequency band in which an efficiency of more than 90% is exhibited is around 800 MHz. Accordingly, the broadband characteristic can be achieved.

In particular, the present invention may be used to achieve a high gain characteristic in both a frequency range (2.3 GHz~2.39 GHz) for Wibro, which is a wireless Internet service, and a frequency range (2.63 GHz~2.655 GHz) for Digital Multimedia Broadcasting (DMB), because it has a broadband antenna characteristic.

Figure 6:
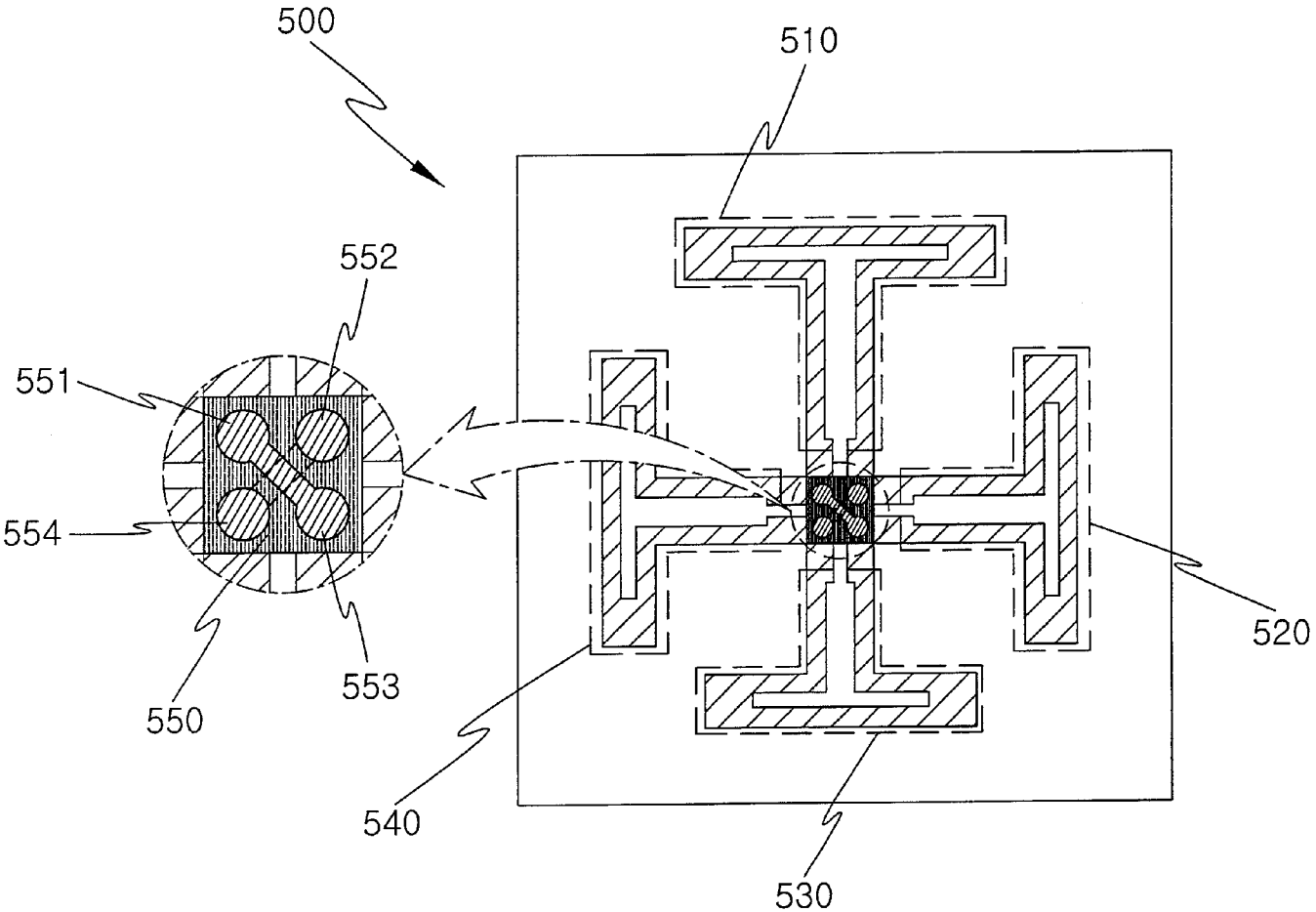
FIG. 6 is a front view of a dual polarization broadband antenna having a single pattern according to another embodiment of the present invention.

FIG. 6 is a front view of a dual polarization broadband antenna having a single pattern according to another embodiment of the present invention. The dual polarization broadband antenna includes a radiation device 500 having a rectangular structure, in which a plurality of folded dipole elements 510, 520, 530 and 540 are formed thereon in a single continuously-connected pattern, and a feeding portion 550 configured to feed signals to the plurality of folded dipole elements 510, 520, 530 and 540 is formed on the radiation device 500.

In greater detail, the radiation device 500 is configured such that the first to fourth folded dipole elements 510, 520, 530 and 540 are formed thereon and are coupled to the feeding portion 550 to feed signals, thus radiating a signal formed using vector addition for the first to fourth folded dipole elements 510, 520, 530 and 540.

The plurality of folded dipole elements 510, 520, 530 and 540 are formed at different lengths, so that squint error can be decreased.

The feeding portion 550 is configured such that first to fourth feeding points 551, 552, 553 and 554 are formed in respective locations, in which the first to fourth feeding line portions 511, 521, 531 and 541 of the first to fourth folded dipole elements 510, 520, 530 and 540 are interconnected, the first feeding point 551 and the third feeding point 553 are connected to each other, the second feeding point 552 and the fourth feeding point 554 are connected to each other, and the connected first and third feeding points 551 and 553 and the connected second and fourth feeding points 552 and 554 are formed to cross each other, thus causing dual polarization by enabling signals, which are supplied from the outside, to be dually fed to the first to fourth folded dipole elements 510, 520, 530 and 540.

Furthermore, the current flowing into the feeding portion 550 is induced only by the first to fourth folded dipole elements 510, 520, 530 and 540, so that excellent isolation characteristics can be achieved.

Figure 7:
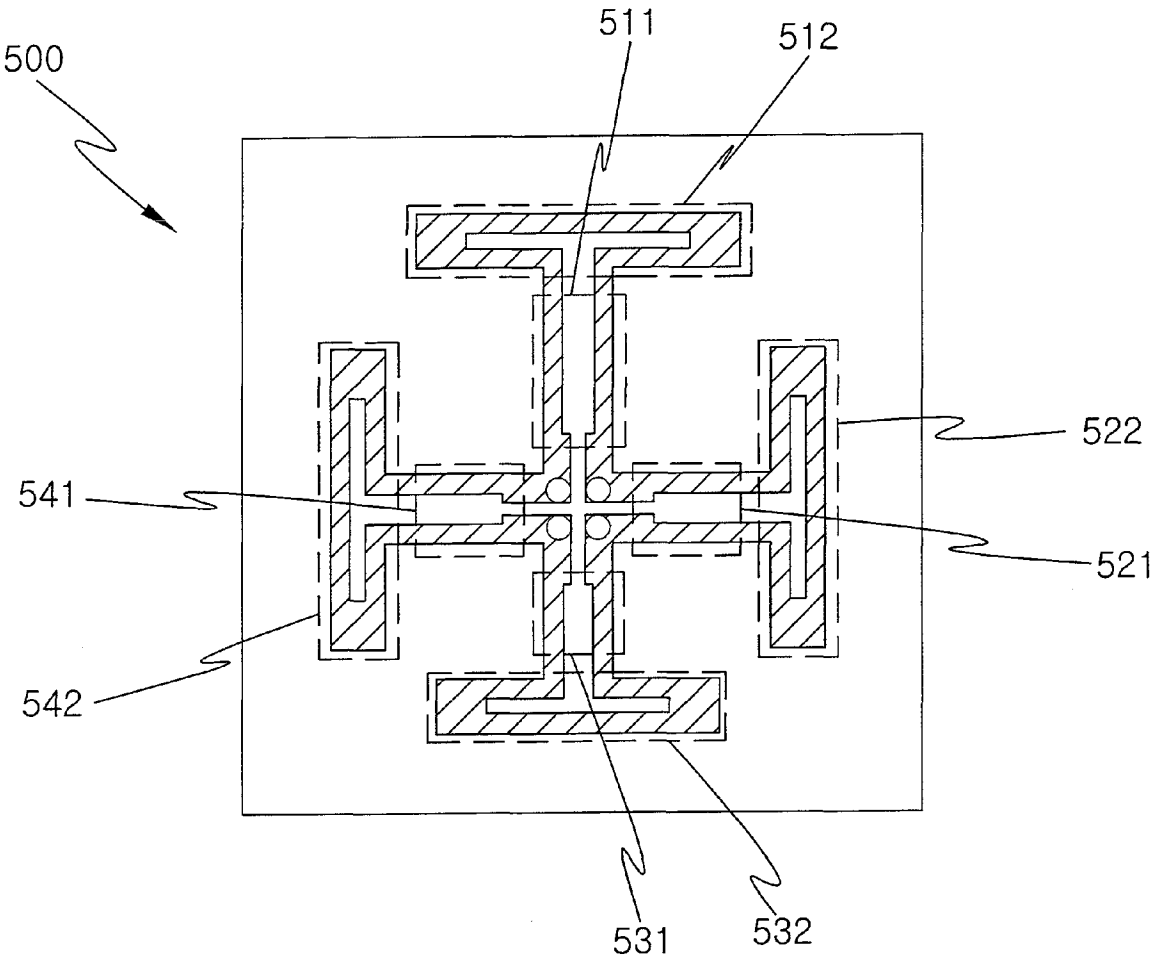
FIG. 7 is a diagram showing the construction of a folded dipole antenna having a single pattern according to FIG. 6 of the present invention.

The first folded dipole element 510, as shown in FIG. 7, is provided with the first radiation portion 512 and the first feeding line portion 511. In this case, current supplied from the outside to the feeding portion 550 flows into the first feeding line portion 511 and the current flowing to the first feeding line portion 511 is induced to the first radiation portion 512.

Furthermore, the second, third and fourth folded dipole elements 520, 530 and 540 are respectively provided with the second feeding line portion 521 and a second radiation portion 522, the third feeding line portion 531 and a third radiation portion 532, and the fourth feeding line portion 541 and a fourth radiation portion 542. In this case, current is induced to each of the second, third and fourth radiation portions 522, 532 and 542 in response to the signals that flow into the feeding portion 150.

In particular, it can be seen that the plurality of folded dipole elements 510, 520, 530 and 540 is set such that the second and fourth folded dipole elements 520 and 540 have the same length, the first folded dipole element 510 is relatively long, and the third folded dipole element 530 is relatively short, and thus the folded dipole elements 510, 520, 530 and 540 are formed at different lengths, with the result that the squint error is decreased.

In addition, when the plurality of folded dipole elements 510, 520, 530 and 540 are formed at different lengths, the magnitude and phase of each of the currents varies arbitrarily. In this case, the magnitude and phase of the positive (+) current and the magnitude and phase of the negative (−) current differ from each other, and the magnitudes and phases of the electric fields also differ from each other, so that the electric field obtained through the vector addition varies, and the beam orientation of the plurality of folded dipole elements 510, 520, 530 and 540 varies. Therefore, the squint error can be decreased.

Figure 8:
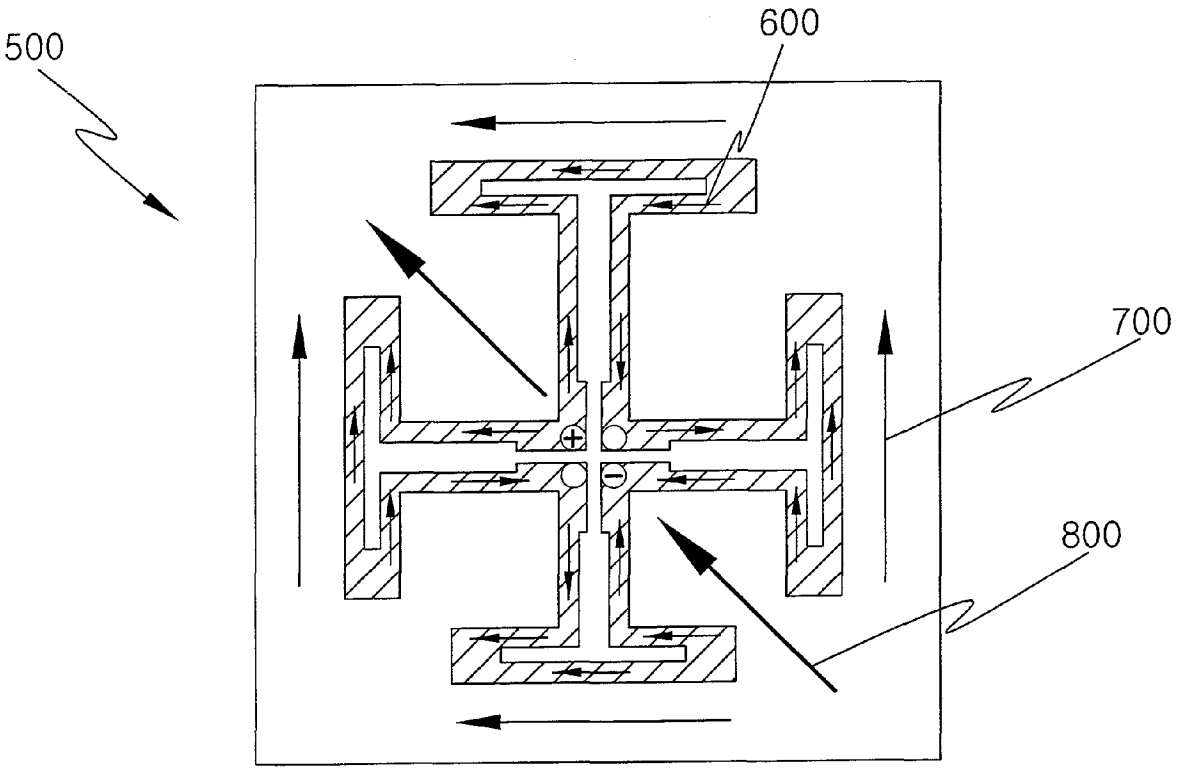
FIG. 8 is a diagram showing polarization caused by a first current flow according to FIG. 6 of the present invention.
Figure 9:
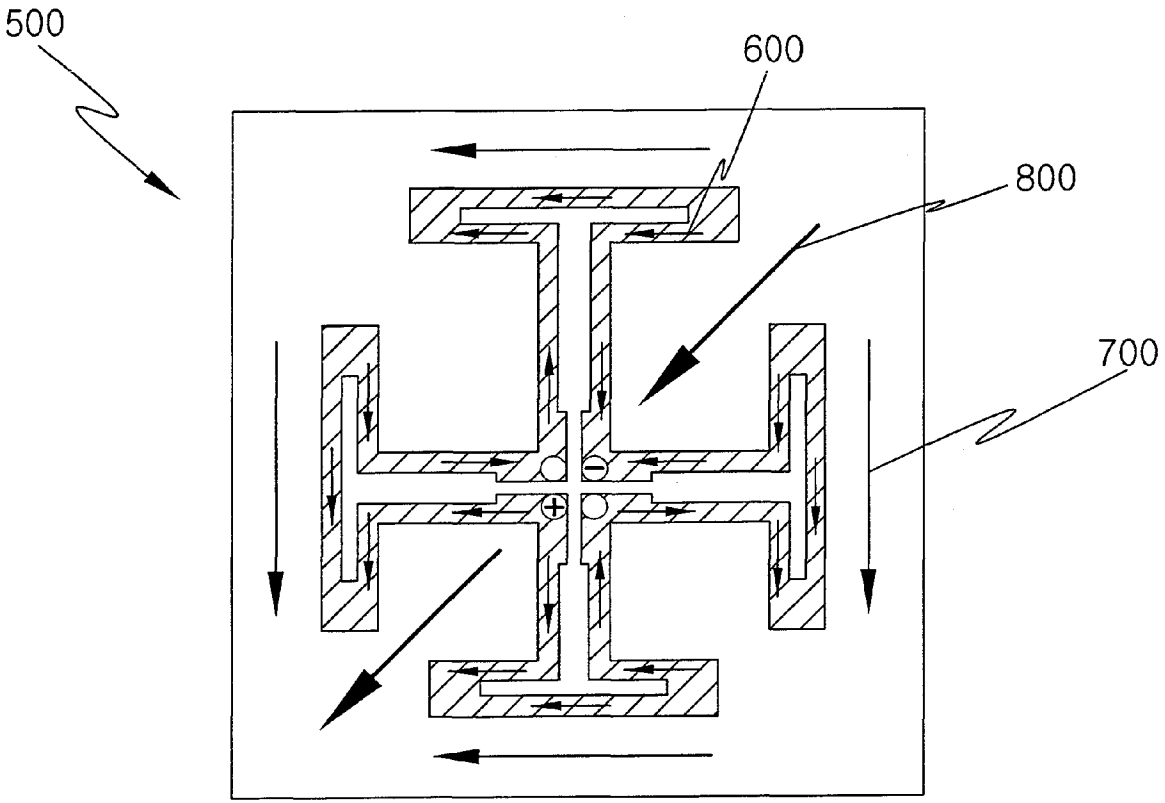
FIG. 9 is a diagram showing polarization caused by a second current flow according to FIG. 6 of the present invention.

FIG. 8 is a diagram showing polarization caused by a first current flow according to FIG. 6 of the present invention, in which one of the dual polarizations, obtained through the vector addition of an electric field generated by the first current flow, is shown. FIG. 9 is a diagram showing a polarization caused by a second current flow according to FIG. 6 of the present invention, in which the other polarization, which is obtained through the vector addition of an electric field generated by the second current flow, is shown.

In greater detail, as shown in FIG. 8, a positive (+) current is applied to the first feeding point 551 and a negative (−) current is applied to the third feeding point 553, so that current directions 600 are respectively formed along the first to fourth folded dipole elements 510, 520, 530 and 540 by the applied currents, the directions 700 of respective electric fields are formed to correspond to the first to fourth folded dipole elements 510, 520, 530 and 540 by the flow of the currents, and a polarization direction 800 is formed at an angle of +45° by the vector addition of the formed electric fields.

In FIG. 9, a positive (+) current is applied to the fourth feeding point 554 and a negative (−) current is applied to the second feeding point 552, so that the directions 700 of electric fields are determined by the current directions 600 of the first to fourth folded dipole elements 510, 520, 530 and 540, and a polarization direction 800 is formed at an angle of −45° by the vector addition of the formed electric fields.

Accordingly, in FIGS. 8 and 9, the directions 700 of electric fields are determined by the current directions 600, and the polarization direction 800 is formed at an angle of +45° or −45° by the vector addition of the formed electric fields, and thus the dual polarization characteristic for the polarization direction 800 can be achieved.

Figure 10:
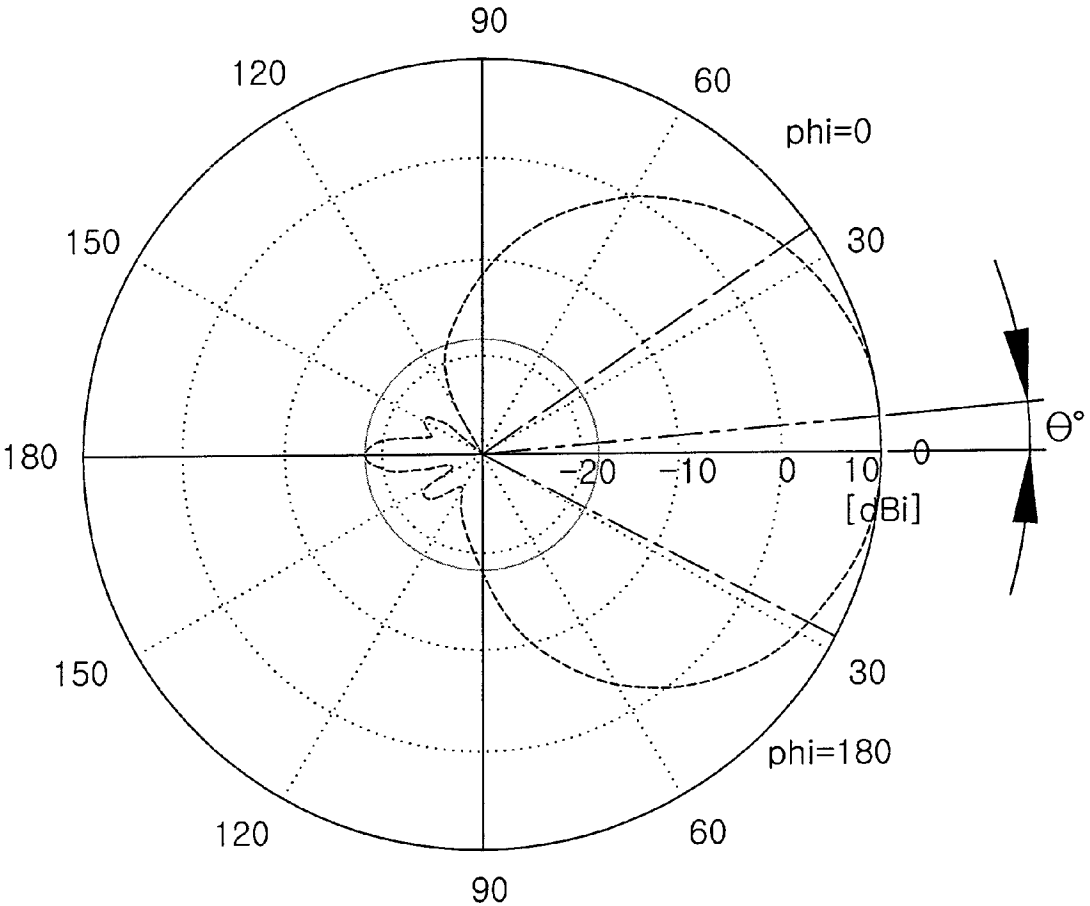
FIGS. 10 and 11 are diagrams indicating whether squint error occurs according to FIG. 6 of the present invention.
Figure 11:
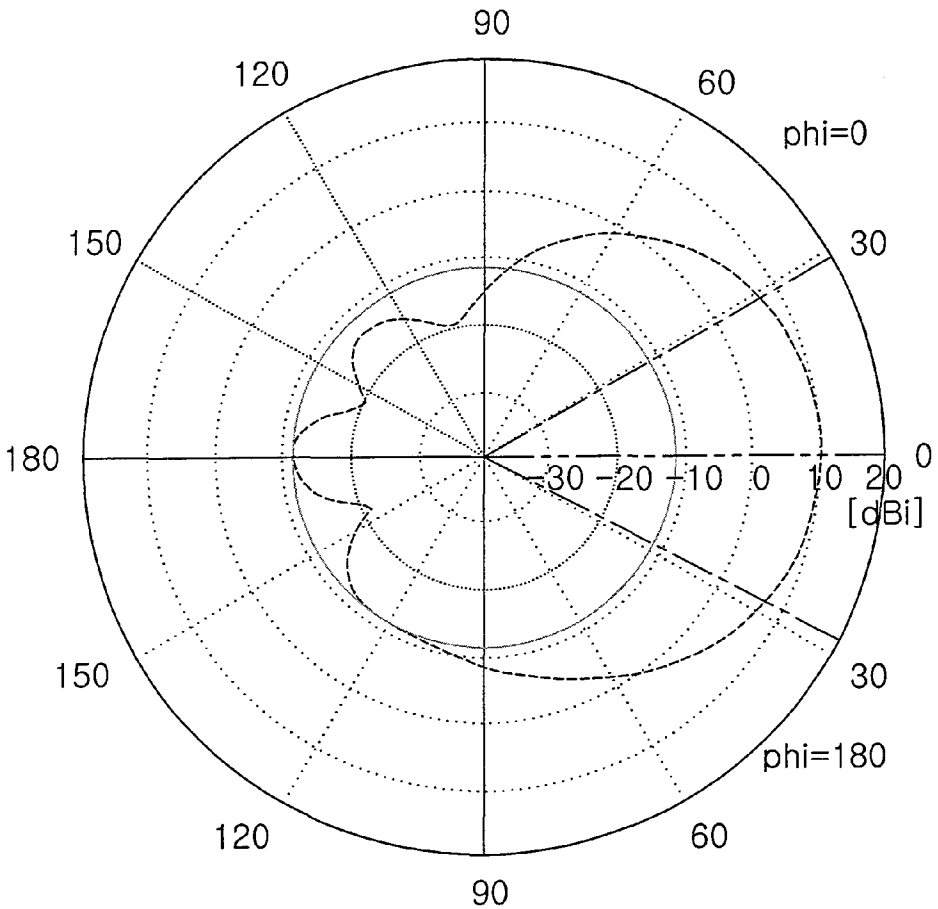

FIG. 10 and 11 are diagrams showing whether squint error occurs according to FIG. 6 of the present invention. FIG. 10 shows that the forward direction of the antenna is 0° and the radiation direction of the antenna varies from 0° to θ°. In this case, such variation is called squint error. In contrast, FIG. 11 shows that the forward direction of the antenna is 0° and the radiation direction of the antenna is 0°, and thus there is no squint error. Accordingly, it can be seen that an adjustment is made such that the folded dipole elements have different lengths, so that the radiation direction deviated by a specific angle in the forward direction is compensated for, therefore the squint error can be decreased.

Although the present invention has been described above in detail, it should be understood that the embodiments mentioned in the process are only illustrative and not restrictive. Furthermore, modifications in the elements of the present invention within the extent that they represent equal replacements in a range that does not depart from the technical spirit of the present invention, defined by the following claims, should be considered as being included in the scope of the present invention.

The invention claimed is:

1. A dual polarization broadband antenna having a single continuously-connected pattern, comprising:

a planar radiation device having a rectangular structure and having a plurality of folded dipole elements formed in a single continuous closed-loop pattern, the rectangular structure formed by outer lines of each of the dipole elements; and a feeding portion configured to feed signals to the plurality of folded dipole elements formed on the radiation device, wherein the plurality of folded dipole elements includes a first folded dipole element to a fourth folded dipole element, and the feeding portion comprises one of four feeding points located between each of the folded dipole elements, the four feeding points being formed to cross each other and configured to simultaneously feed the signals, and wherein the second folded dipole element and the fourth folded dipole element have the same length, the first folded dipole element has a longer length, and the third folded dipole element has a shorter length such that squint error is decreased when alternate feeding points are fed.

2. The dual polarization broadband antenna according to claim 1, wherein each of the plurality of folded dipole elements comprises a feeding line portion and a radiation portion.

3. The dual polarization broadband antenna according to claim 1, wherein the plurality of folded dipole elements decreases squint error.

4. The dual polarization broadband antenna according to claim 3, wherein the plurality of folded dipole elements causes polarization through vector addition of electrical fields formed by flow of current fed to the feeding portion.

5. The dual polarization broadband antenna according to claim 4, wherein the plurality of folded dipole elements forms dual polarizations using a single pattern in response to the signals that are dually fed to the feeding portion single pattern.

6. The dual polarization broadband antenna according to claim 5, wherein the plurality of folded dipole elements causes a polarization direction to be formed at an angle of +45° or −45° in response to the signals that are dually fed to the feeding portion.

* * * * *